United States Patent [19]

Bailey

[11] Patent Number: 4,834,290

[45] Date of Patent: May 30, 1989

[54] RISER FOR AN IRRIGATION SPRINKLER

[76] Inventor: James L. Bailey, P.O. Box 119, Collaroy Beach, NSW 2097, Australia

[21] Appl. No.: 51,929

[22] Filed: May 19, 1987

[51] Int. Cl.[4] ..... B05B 15/10

[52] U.S. Cl. ..... 239/205; 239/204; 239/533.14

[58] Field of Search ..... 239/203, 204, 205, 206, 239/533.13, 533.14; 254/390; 267/74, 153

[56] References Cited

U.S. PATENT DOCUMENTS

| | | | |
|---|---|---|---|
| 1,079,445 | 11/1913 | Smith | 254/390 |
| 1,800,858 | 4/1931 | Buelna | 239/205 |
| 2,901,183 | 8/1959 | Kohl | 239/205 |
| 3,002,696 | 10/1961 | Jenkins | 239/204 |
| 3,282,508 | 11/1966 | Roberts | 239/204 |
| 4,570,866 | 2/1986 | Drower | 267/69 |
| 4,616,780 | 10/1986 | Abbott | 239/205 |

*Primary Examiner*—Andres Kashnikow
*Assistant Examiner*—Christopher G. Trainor
*Attorney, Agent, or Firm*—Harness, Dickey & Pierce

[57] ABSTRACT

An improved riser for a pop up sprinkler system wherein the riser is supported by a single flexible diaphragm relative to the supporting housing and an elastic rope acts as the return member for the riser and holds the riser in a vertical position when extended.

4 Claims, 3 Drawing Sheets

RISER FOR AN IRRIGATION SPRINKLER

BACKGROUND OF THE INVENTION

This invention relates to an improved riser for an irrigation sprinkler and more particularly to an improved biasing arrangement for such a riser for urging the riser to its normally retracted position and for retaining it in a vertical position when it has popped up.

As is well known, there are a wide variety of in-ground sprinkler systems that employ a housing that is adapted to be buried within the ground and which supports a riser for movement from a retracted position to an extended sprinkling position. A wide variety of spray heads are carried by the risers for irrigating and/or watering the surrounding terrain when the riser pops up under water pressure. Although such devices offer considerable convenience, there are certain disadvantages to the prior art types of construction which have rendered them less than fully suitable for their intended purpose. For example, the sliding support between the riser and its housing should be such that it will not be prone to sticking when grass, the soil or materials that are added in granular form to the soil for purposes such as fertilizing, insect or weed control or the like become lodged within the housing. In addition, the riser should be capable of substantial movement between its retracted position and its extended sprinkling position so as to insure good water distribution when the riser pops up.

In order to obviate certain of the aforenoted disadvantges, it has been proposed to provide a sprinkler of the type generally described wherein a flexible diaphragm is interconnected between the supporting housing and the riser. Such a diaphragm serves the combined purpose of providing a seal between the housing and the riser and also can function to provide the support for the riser and its movement between its retracted and its storage position. Although such diaphragm type arrangements can offer some advantages, those which have been proposed in the prior art are not fully effective to achieve their intended purpose. For example, a conventional diaphragm cannot have sufficient resilience to permit the desired degree of movement and also so as to insure retraction of the riser when water pressure is not present. For this reason, it has been proposed to employ helper springs or retraction springs for retracting the riser when it is not in use. However, consistent with maintaining a compact overall size, the type of spring arrangements previously employed have not served their intended purposes. Either they have sufficient force so as to effect retraction and, accordingly, restrict the overall movement or they will permit the necessary degree of lift for the riser and then do not have sufficient force to insure good retraction and smooth movement throughout the entire range of travel. Also, the spring arrangements previously employed have not offered sufficient force and direction of force application to hold the riser in a vertical position when extended.

It is, therefore, a principal object of this invention to provide an improved riser for a pop up type irrigation sprinkler.

It is a further object of this invention to provide a riser that will have substantial movement and which embodies an effective retraction spring that permits such large degrees of movement and holds the riser in a vertical position when extended.

It is a further object of this invention to provide an improved retraction spring arrangement for a pop up type of riser.

SUMMARY OF THE INVENTION

This invention is adapted to be embodied in an improved riser for a sprinkling system or the like which comprises an outer housing defining an internal cavity. A riser is supported for movement within the housing internal cavity from a retracted position to an elevated spraying position. Biasing means are provided for resiliently retaining the riser in its retracted position and for urging the riser from its elevated spraying position to its retracted position. The biasing means in accordance with the invention comprises a resilient member affixed at one end relative to the housing and fixed at its other end to the riser. The portion of the biasing means between the two ends is elastic and is extendable in length for providing the retraction forces necessary.

DETAILED DESCRIPTION OF THE PREFERRED EMBODIMENT

Figure 1:
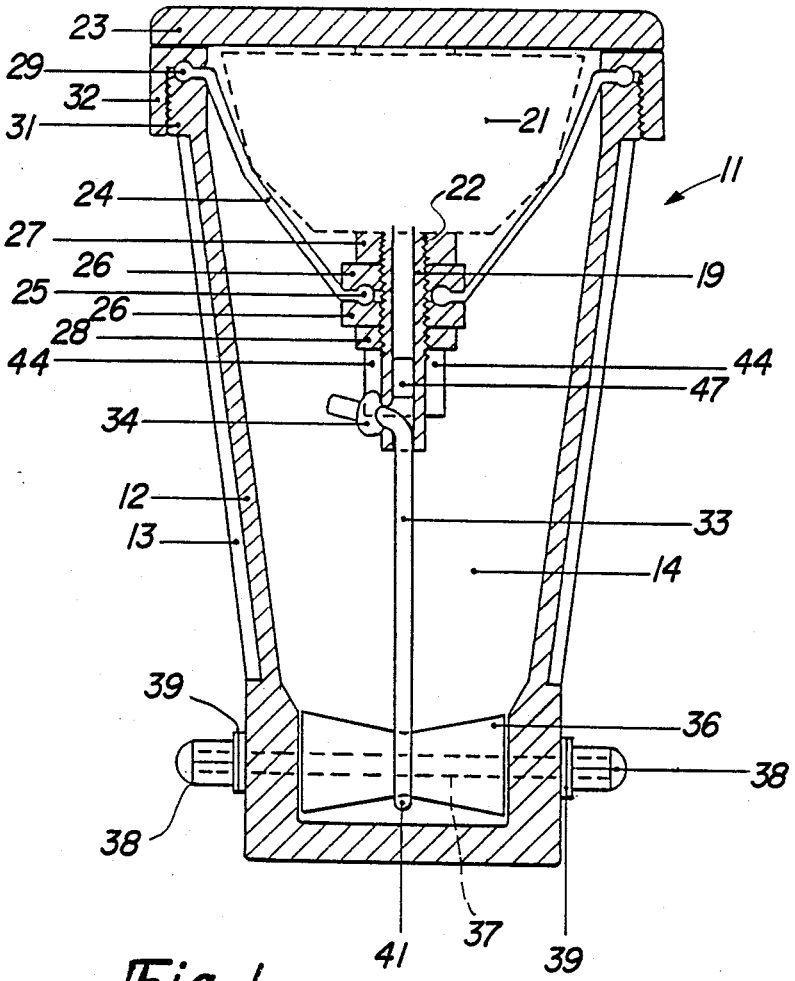
FIG. 1 is a cross-sectional view of an improved riser for a pop up sprinkling system constructed in accordance with an embodiment of the invention and showing the riser in its retracted position.

Referring now in detail to the drawings, an improved riser for a pop up irrigation sprinkler embodying the invention is identified generally by the reference numeral 11. The pop up sprinkler 11 includes an outer housing 12 which may be formed from a cast metal or the like and which is provided with vertically extending strengthening ribs 13. The housing 12 defines an internal cavity 14 to which fluid may be admitted through either a selected side inlet 15 or bottom inlet 16. The inlets 15 and 16 are normally closed for shipping and installation purposes by means of a pair of plugs 17 and 18. Depending upon the type of installation, one of the plugs 17 or 18 is removed so that water may be supplied to the cavity 14 through the selected fitting 15 or 16.

Figure 2:
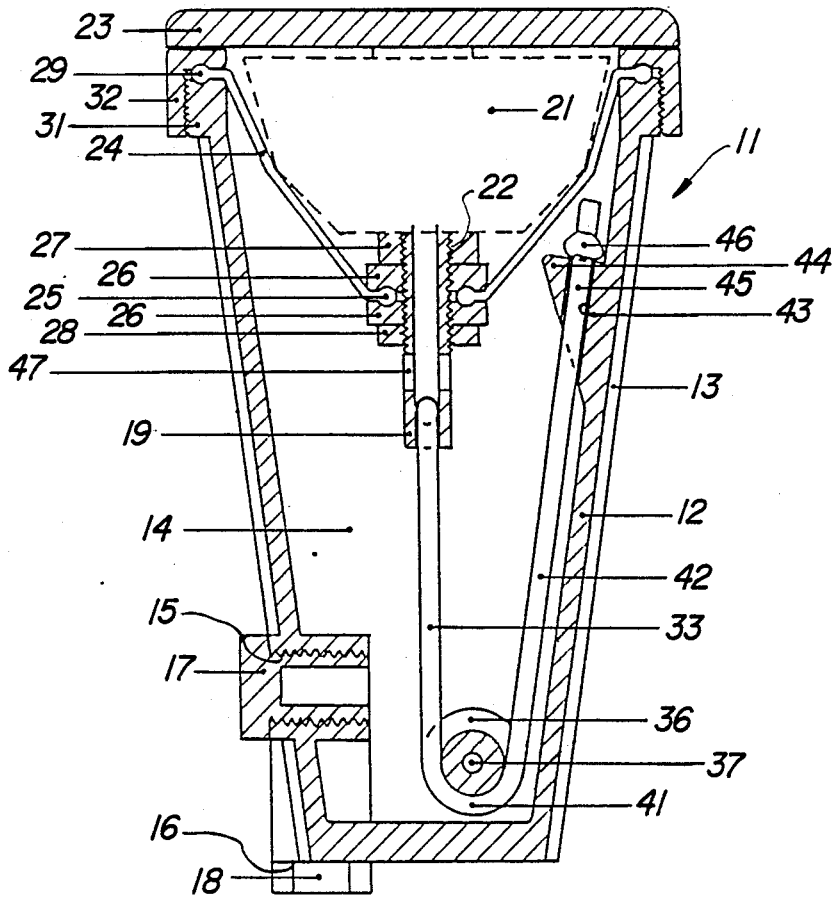
FIG. 2 is a cross-sectional view taken through a plane that is perpendicular to the plane of FIG. 1.
Figure 3:
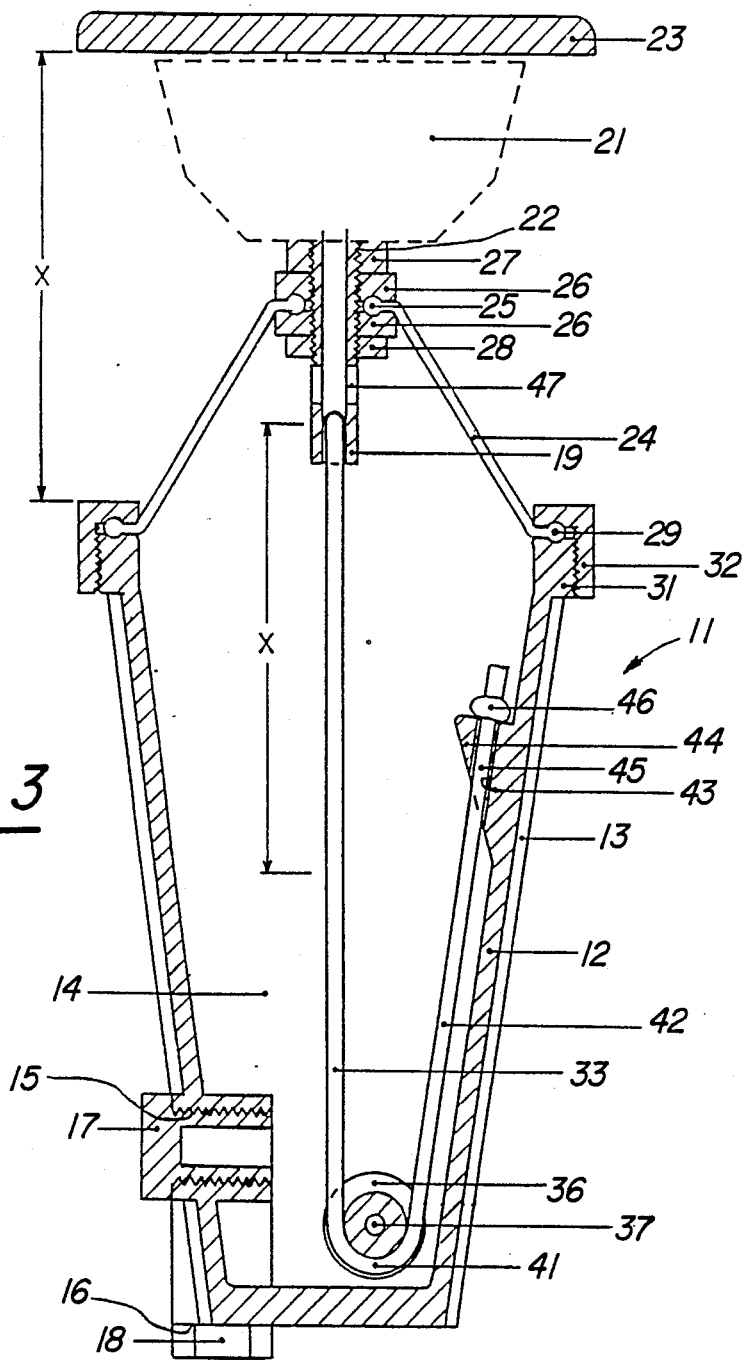
FIG. 3 is a cross-sectional view taken along the same plane as FIG. 2 and shows the riser in its popped up spraying position.

A riser tube 19 is supported within the cavity 14 for movement between a retracted position as shown in FIGS. 1 and 2 and an extended spraying position as shown in FIG. 3 in a manner to be described. The riser tube 15 is adapted to carry a sprinkler head 21 of any known type, and shown in phantom in the drawings, at its upper end and is threaded, as at 22 for this purpose. In addition, a cap 23 is carried at the upper end of the sprinkler head 21 and is adapted to sealingly engage the upper end of the housing 12 when the riser 19 and sprinkler 21 are held in their retracted position as shown in FIGS. 1 and 2.

A flexible diaphragm 24 which is formed from a suitable elastomeric material has an inner opening that is received around the riser tube 19 and which is defined by a peripheral rib 25. The rib 25 is clamped between a pair of internally threaded collars 26 which, in turn, have a suitable recess for receiving the rib 25. The threaded part 27 of the riser and a lock nut 28 cooperate with the threaded collars 26 for retaining the diaphragm 24 and riser tube 19 to each other.

The diaphragm 24 has an outer peripheral rib 29 that is received in a corresponding recess formed by an externally threaded upper portion 31 of the housing 12. An internally threaded collar 32 is received upon the portion 31 and has a complementary recess for clamping the diaphragm rib 29 between the collar 32 and the housing portion 31 in a fluid tight relationship.

An elastomeric biasing means is interposed between the housing 12 and the riser 19 for holding the riser 19, sprinkler head 21 and closure cover plate 23 in the closed position as shown in FIGS. 1 and 2. This elastomeric biasing means comprising an elongated elastomeric rope 33 that extends through an opening formed in the riser 19 and which passes through a suitable opening in the side of the riser. This end is affixed to the riser 19 by forming a knot or ferrule 34 upon it. In order to permit a greater range of movement of the riser 19 to its extended spraying position (FIG. 3), the elastomeric rope 33 is doubled back upon itself by passing it over a tapered roller 36 that is journaled at the lower end of the housing 12 upon a shaft 37. The shaft 37 is held axially in place by means of cap nuts 38 and washers 39 that are received on the exposed ends of the shaft 37. These ends are, of course, threaded so as to accommodate the cap nuts 38. An arcuate portion 41 of the elastomeric rope 33 passes across the tapered roller 36 in a re-entrant fashion as clearly shown in FIGS. 2 and 3.

The rope 33 has a re-entrant portion 42 that extends parallel to the side wall of the housing 15 and which passes through an opening 43 formed in a lug 44 of the housing 12 adjacent its upper end. A part 45 of the rope portion 42 extends thrugh the opening 43 and a ferrule or knot is formed on the upper end of the rope 33 to engage the upper surface of the lug 44 and retain this end of the rope 33 in position.

The elastic rope 33 is pretensioned so as to exert a predetermined closing force for holding the riser 19 in its retracted position so that the cover plate 23 sealingly engages the collar 32. However, when fluid pressure is admitted through either the fitting 15 or 16 into the cavity 17, the diaphragm 24 will deflect upwardly as shown in FIG. 3 so that the sprinkler 21 and riser 19 will pop up. It should be noted that the riser 19 is provided with flow openings 47 so that the water may flow from the cavity 14 out the sprinkler head 21 when it is popped up as shown in FIG. 3. Under this condition, the rope 33 will elastically extend a distance X, equal to the distance X which the sprinkler head 21 pops up. However, since the rope 33 is doubled back upon itself over the roller 36, unit stresses will be kept low and it is possible to achieve a higher degree of popping up than with prior art devices. As should be readily apparent, when the water pressure is discontinued, the rope 33 will again contract and pull the sprinkler head 21 and riser 19 downwardly to the position shown in FIGS. 1 and 2.

In addition to providing the retraction force, the elastomeric rope 33 also exerts a force on the lower end of the riser 19 in an axial direction so as to maintain the riser 19 and sprinkler head 21 in a vertically oriented position during movement from the retracted position to the elevated position and while in the elevated position. This force increases as the extension of the riser 19 and sprinkler head 21 occurs and thus it is insured that the riser will move in a vertical direction upon its extension without further stabilizing means.

It should be readily apparent from the foregoing description that a very simple yet highly effective device is provided. In addition to permitting a high degree of popping up, the fact that the rope 33 extends in an axial direction will insure that the riser 19 moves in a linear fashion relative to the housing 12 and thus a single flexible diaphragm 24 can be utilized for positioning the riser in combination with the elastic rope 33. Furthermore, the top positioning of the diaphragm 24 will insure that the sprinkler head and other internal components do not become damaged with soil or other ground materials.

It is to be understood that the foregoing description is that of a preferred embodiment of the invention and that various changes and modifications may be made without departing from the spirit and scope of the invention, as defined by the appended claims.

I claim:

1. An improved riser for an underground sprinkler system or the like comprising an outer housing defining an internal cavity having an upper rim defining an upwardly facing groove, a diaphragm having a peripheral edge received in said groove, a clamping ring secured to said outer housing and retaining said diaphragm peripheral edge in said groove, a riser fixed to the center of said diaphragm and supported thereby for movement relative to said housing from a retracted position to an elevated spraying position, and an elastic rope for resiliently retaining said riser in said retracted position and for urging said riser from said elevated spraying position to said retracted position, said elastic rope having a first portion fixed at one end to said riser and extending in an axial direction from said riser to a lower wall of said housing and a second portion extending from the lower end of the first portion back upwardly to an end which is fixed to said housing, the portion of said biasing means between said ends being elastically deformable for increasing the length between said ends upon movement of said riser from said retracted position to said elevated spraying position.

2. An improved riser as set forth in claim 1 further including roller means carried by the housing around which the rope passes.

3. An improved riser for an underground sprinkler system or the like comprising an outer housing defining an internal cavity, a riser supported for movement relative to said housing from a retracted position to an elevated spraying position, and biasing means for resiliently retaining said riser in said retracted position and for urging said riser from said elevated spraying position to said retracted position, said biasing means comprising an elastic rope having a first portion affixed at one end of said rope to said riser and extending in an axial direction from said riser to a lower wall of the housing and a second portion extending from the lower end of the first portion back upwardly to an outer end of said rope, said other end being fixed to said housing at a point above said first end when said riser is in its retracted position.

4. An improved riser as set forth in claim 3 further including roller means carried by the housing around which the rope passes.

* * * * *